US006757932B1

(12) United States Patent
Verstraeten

(10) Patent No.: US 6,757,932 B1
(45) Date of Patent: Jul. 6, 2004

(54) DRIVING DEVICE FOR FLEXIBLE LANCE

(75) Inventor: Paul F. M. Verstraeten, Hooqvliet (NL)

(73) Assignee: Peinemann Equipment B.V. (NL)

( * ) Notice: Subject to any disclaimer, the term of this patent is extended or adjusted under 35 U.S.C. 154(b) by 123 days.

(21) Appl. No.: 10/048,263

(22) PCT Filed: Aug. 8, 2000

(86) PCT No.: PCT/NL00/00557

§ 371 (c)(1),
(2), (4) Date: Apr. 24, 2002

(87) PCT Pub. No.: WO01/11303

PCT Pub. Date: Feb. 15, 2001

(30) Foreign Application Priority Data

Aug. 11, 1999 (NL) ..... 1012806

(51) Int. Cl.[7] ..... B08B 9/043; B08B 9/04
(52) U.S. Cl. ..... 15/315; 15/316.1
(58) Field of Search ..... 15/312.2, 315, 15/316.1; 134/167 C, 167 R, 198

(56) References Cited

U.S. PATENT DOCUMENTS 5,184,636 A * 2/1993 van der Woude ..... 134/167 C
6,596,090 B2 * 7/2003 Schmidt ..... 134/15

FOREIGN PATENT DOCUMENTS

FR 2424078 * 4/1978
JP 07-204598 * 8/1995
JP 09-329686 * 12/1997

* cited by examiner

*Primary Examiner*—Terrence R. Till
(74) *Attorney, Agent, or Firm*—Mark Zovko

(57) ABSTRACT

Device (11) for driving a flexible lance (4) for cleaning a heat exchanger duct, provided with a frame (1) in which a drive (12) driving a flexible lance (4) is arranged for moving this flexible lance (4) in the direction of an outlet opening. The drive (12) is provided with a member (27) which can be clamped round the flexible lance (4) and which is movable in the frame (1) towards and away from this outlet opening.

5 Claims, 3 Drawing Sheets

DRIVING DEVICE FOR FLEXIBLE LANCE

BACKGROUND OF THE INVENTION (1) Field of the Invention

The present invention relates to a driving device for a flexible lance.

(2) Description of Related Art

A flexible lance is used to clean the ducts in a heat exchanger. In the course of time these ducts become fouled such that the through-flow is blocked to a greater or lesser degree. In order to enable the heat exchanger to function optimally again the ducts, particularly the pipes thereof, are cleaned by injecting liquid under high pressure through these ducts using a high-pressure lance.

BRIEF SUMMARY OF THE INVENTION

A known device makes use of lances in the form of high-pressure hoses which carry a high-pressure injection nozzle on their front end. These hoses are pushed from a reel into the heat exchanger pipes. After the high-pressure source for the washing liquid has been set into operation, the dirt is removed from the duct and the hose can herein be pushed further into the pipe, until the whole length of the pipe is cleaned.

In the known device the flexible lance is taken up on a reel which is rotatable. A co-displacing enclosure is formed around the reel so that the hose can be unwound from the reel with drive power in order to push the hose into the duct for cleaning. It is noted that the high-pressure nozzle of the lance is herein embodied such that a part of the high-pressure liquid is sprayed out backwards, so that a pulling force is developed.

The known device is herein disposed fixedly in front of the heat exchanger to be cleaned.

The object of the invention is to provide a device of the present type, which can be readily manipulated and wherein particularly heat exchangers which are difficult to access and placed vertically can be properly cleaned.

This object is achieved with the device according to the invention, the embodiment of which is shown in the annexed figures.

DETAILED DESCRIPTION OF THE INVENTION

Figure 1:
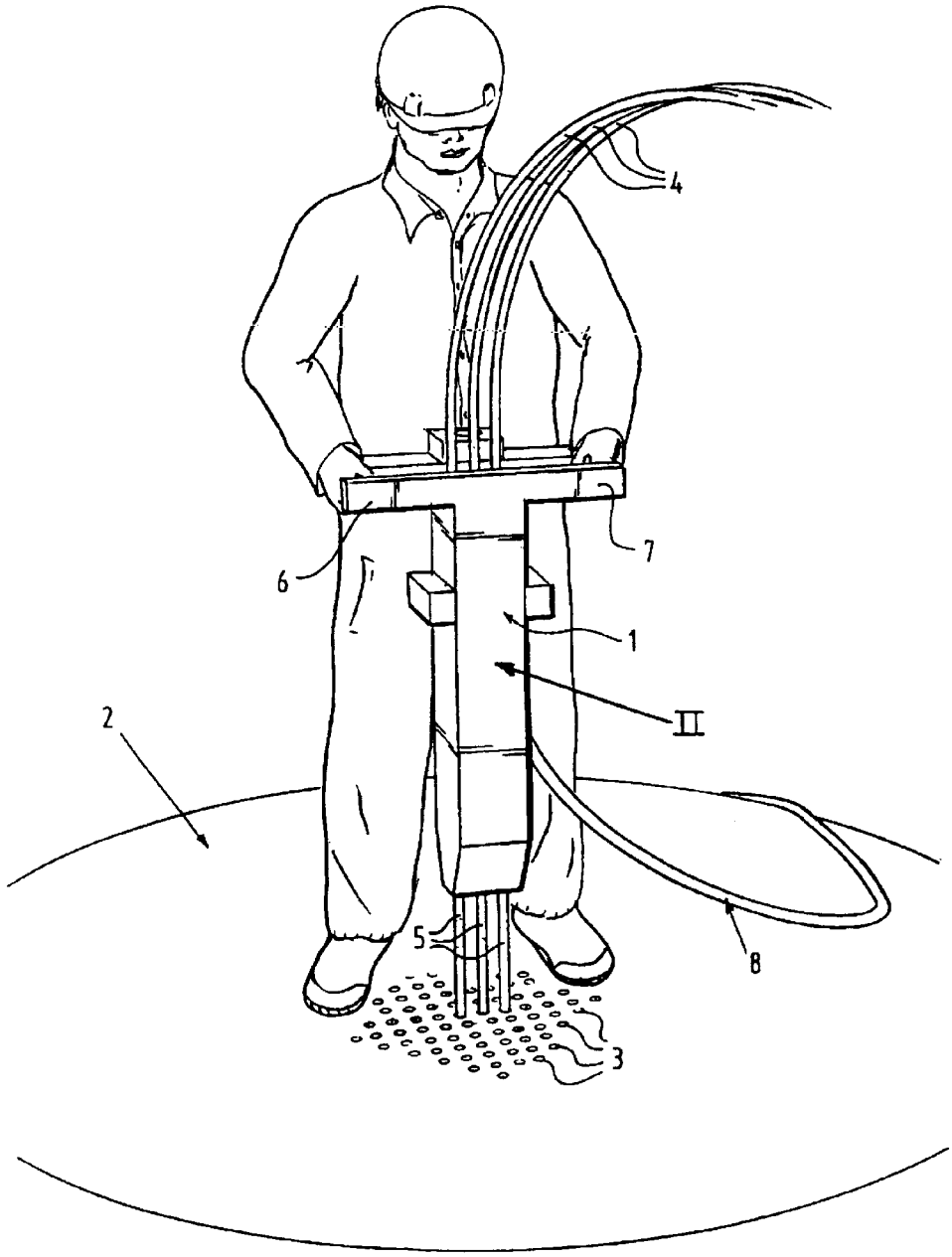
FIG. 1 shows schematically the use of the device according to the invention.

As shown in FIG. 1, the driving device 1 for flexible lances is used by an operator, in this case to clean pipes 3 of a standing heat exchanger 2.

Device 1 generally comprises a driving device to be described further for moving high-pressure hoses 4 into and out of pipes 3. In per se known manner these high-pressure hoses 4 carry on their front end injection nozzles with which the dirt deposited in pipes 3 can be sprayed loose.

The supply of liquid under high pressure via hoses 4 is herein controlled via a control handle 6, which is to be described further, on a protruding part of device 1. The driving of lances 4 likewise takes place with a handle 7, also to be described further, on the opposite side of device 1. The line for controlling the high-pressure generator and an air hose for providing the different components of device 1 with energy run via a line 8, which is likewise connected to device 1.

As FIG. 1 clearly shows, device 1 is easy to handle. Even when only very little space is available above heat exchanger 2, the cleaning operations can still be performed in a sufficiently comfortable manner. Device 1 can optionally be suspended from a so-called "balancer", which compensates the weight of device 1, so that the operator only has to exert force in order to operate the device. In similar manner the device 1 can be used to clean horizontal pipe bundles. Device 1 is then suspended in an A-frame from a balancer such that pipes 5 are held directed horizontally at the front end, through which the lances 4 run.

An important aspect of device 1 is the driving of the lances. For the sake of clarity this is shown in more detail and partly schematically in FIG. 2.

Device 11 has a column-like housing which substantially accommodates drive 12. Extending through this housing in this embodiment are three channels with which three flexible lances can be driven simultaneously. A part of these channels is formed by tubes 13 which guide lances 4 to drive 12, and therefrom to the heat exchanger popes 3 for treating. Drive 12 is thus situated between tubes 13.

The drive 12 substantially comprises two chain systems disposed opposite each other. Mounted in housing 11 are two shafts 14 and 15 on which are arranged schematically designated chain wheels over which run chains. A second pair of shafts 18, 19 is mounted in a sub-frame 21 which is mounted slidably in guide blocks 22 in frame 1, such that this sub-frame can be moved toward and away from the chain system situated opposite.

As shown most clearly on the chain system arranged on sub-frame 21, chain 20 bears a number of connecting brackets 26, which are each in turn connected to clamping elements 27. Each clamping element comprises in this embodiment three semi-cylindrical recesses 25, which co-act with correspondingly placed semi-circular recesses 30 of the clamping elements of the chain system fixedly mounted in housing 11. The co-acting semi-circular recesses can together clamp and co-displace one of the flexible lances 4. Driving of the chain systems takes place with pneumatic motors, which are not shown in FIG. 2. On shafts 14, 18 are moreover arranged tooth wheels 31, which are in mutual engagement in the situation where sub-frame 21 is moved towards the fixed chain system lying opposite.

Between the parts of each chain is arranged in each case a support block 29, which in the left-hand, movable part is fixedly connected to side plates of sub-frame 21 and is connected to housing 11 at the chain system lying opposite.

On their rear side, i.e. on their side remote from the semi-cylindrical openings 25, clamping elements 27 are provided with slide shoes 28 which co-act with these support blocks 29. Slide shoes 28 slide over the surface of support blocks 29. A material is preferably chosen for slide shoes 28 and/or support block 28 which ensures a low coefficient of friction, so that the drive motors effectively use as large a part of their power as possible to drive the lances.

Figure 2:
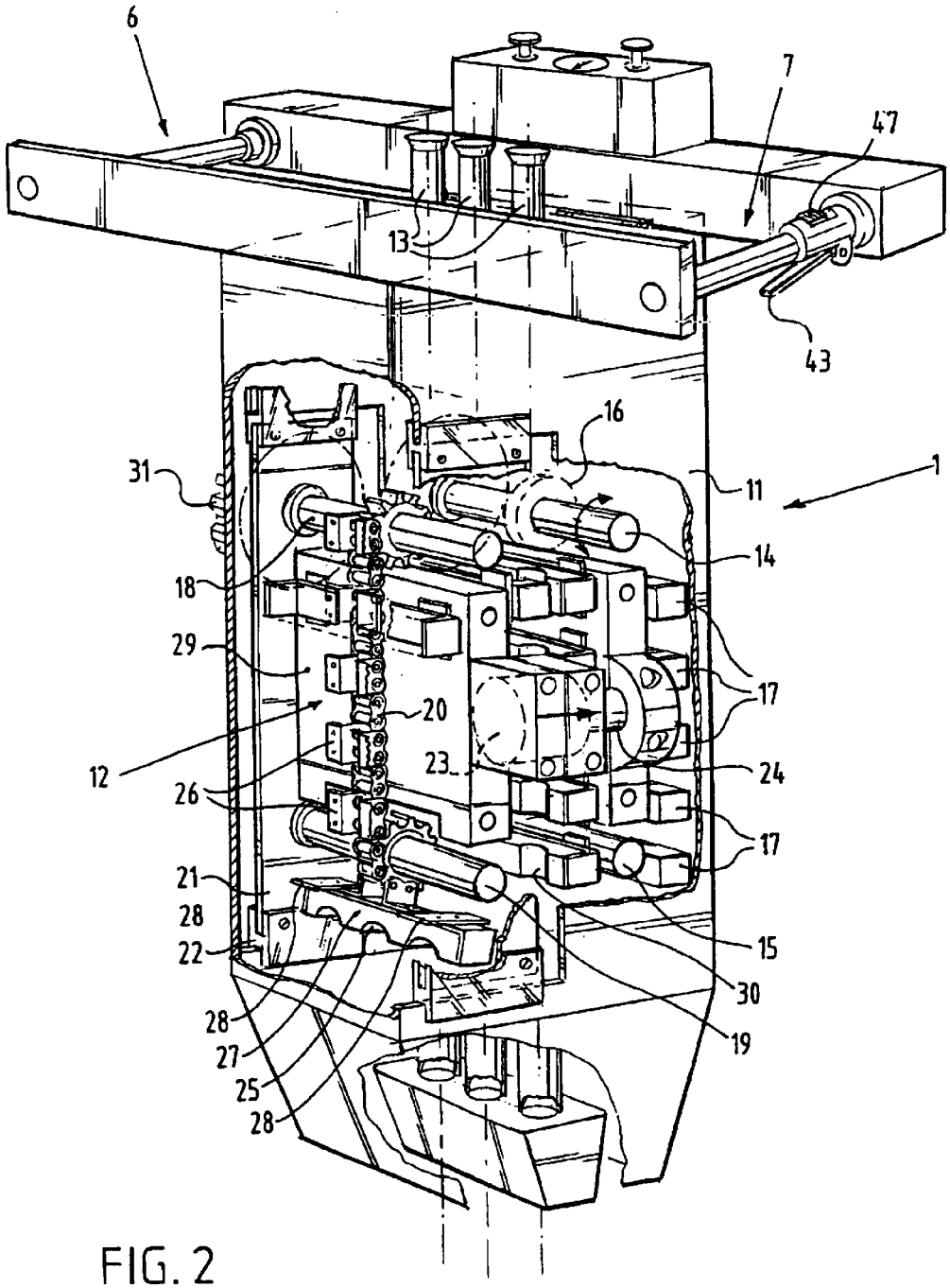
FIG. 2 shows a partly broken away perspective view of the device along arrow II in FIG. 1.

For the sake of simplicity FIG. 2 shows that a pneumatic cylinder 23 is connected to support blocks 29. In actual fact the cylinder 23 is connected to a side plate of sub-frame 21 and piston rod 24 is connected fixedly to frame 11. By supplying compressed air to pneumatic cylinder 23 in a manner to be described further, piston rod 24 will be retracted and support block 29 will thus be urged in the direction toward the opposite support block, wherein clamping elements 27 of the chain systems lying opposite will be pressed against each other via the slide shoes 28 which are in contact with support blocks 29. The flexible lances received in the semi-circular recesses are herein clamped with force and co-displaced during the rotation of the drive.

Figure 3:
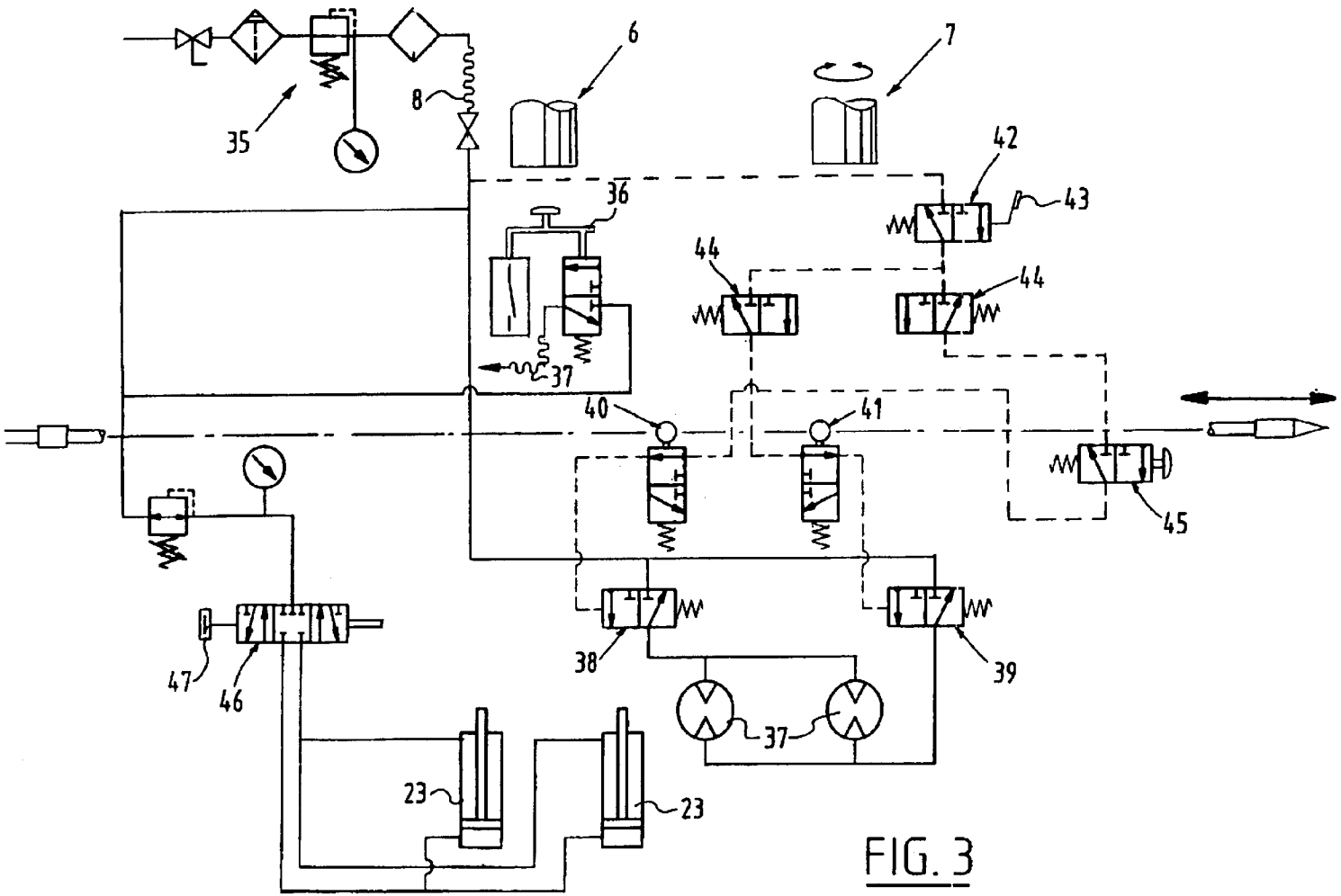
FIG. 3 shows schematically the pneumatic circuit for control of the device.

Operation of device 1 takes place with handles 6, 7. These handles are mounted rotatably on the housing. The different functions can be set into operation and stopped by means of rotation. The pneumatic diagram whereby the different functions are initiated is shown in FIG. 3.

Operation takes place pneumatically, so that compressed air is fed to the system via hose 8 as shown in FIG. 1. Compressed air comes from a compressed air source 35.

Switching on and off of the high-pressure washing liquid via lances 4 takes place with handle 6. A valve 36 is operated in a further self-evident manner by rotating this handle, which valve sends compressed air via lines 37 to a valve of the high-pressure pump.

The chain systems of drive 12 are driven in this case with two pneumatic motors 37. Each of these motors 37 can be coupled, in not further shown but self-evident manner, to one of the shafts of the chain systems. When valve 38 is set into operation, motors 37 will be driven in the one direction of rotation and, when valve 39 is set into operation, in the other direction. A driving of the flexible lances in outward or inward direction can hereby thus be effected. Valves 38 and 39 are controlled with valves 40 respectively 41, which co-act with rotatable handle 7 such that in the one direction of rotation from a neutral position the valve 40 is activated, and in the other direction of rotation the valve 41. A further number of valves is arranged in the control lines preceding valves 38 and 39. In the first place this is a main valve 42 operated by trigger 43. Only when trigger 43 is operated can control air be sent to valves 40, 41 and thus be operated by valves 38, 39. In practice therefore, the desired direction of movement is first chosen with a suitable rotation of handle 7 and the device is then set into operation by pulling on the trigger 43. In case of problems the operator can simply release trigger 43, which returns to its rest position through spring load, and whereby the drive stops. Operating handle 6 is also spring-loaded, so that when this handle is released the feed of washing liquid under pressure is stopped immediately.

End switches 44 and 45 are further arranged in the control line to valves 38, 39. End switches 44 serve for instance to check whether flexible lances 4 are present in the channels. Lances 4 can be provided with a collar which marks the position to which hoses 4 can be inserted into heat exchanger pipes 3. These collars can be detected with the other end switch 44.

End switch 45 is arranged in a manner not shown on the front end of device 1 such that it is pressed in when device 1 is pressed against the heat exchanger, or rests on heat exchanger 2 in the manner of FIG. 1. As soon as lances 4 encounter a great resistance such that they cannot be pushed any further into the pipes, device 1 will be lifted, whereby end switch 45 comes into operation and stops the driving. When the blockage at that location is removed by the action of the injection nozzles of lances 4, device 1 is once again pressed against the heat exchanger, whereby end switch 45 is pressed in and the drive becomes active again.

The clamping of lances 4 by clamping elements 27 takes place with pneumatic cylinders 23, preferably two of which are present on either side of each chain system 1. These pneumatic cylinders 23 are switched on or off using valve 46. This can take place with slide switch 47 on handle 7.

The invention is not limited to the embodiment shown in the figure. Although the described drive device is particularly suitable for mobile use, wherein it is carried by the operator, it can of course also be arranged on the ground. A suitable support frame is then used herein, whereby the device is supported for movement relative to the pipe in the pipe bundles. Depending on the diameter of lances 4, a different number of lances can be moved simultaneously by the device. Three lances can for instance be used in the case of smaller diameters, and this may be two or one at larger diameters. Clamping elements 27 are preferably exchangeable for this purpose such that they can be replaced by clamping elements with recesses 25, 30 which are adapted to the lance 4 to be used. Pipes 13 can also be exchangeable in order to enable the arrangement of a different number or other diameters.

When several lances are driven simultaneously, they will be inserted simultaneously into different pipes of a heat exchanger. In order to place the lances at the correct interspacing corresponding to the centre-to-centre distance of the pipes of the pipe bundle, a guide piece through which lances 4 run will be mounted on the leading end of device 1.

What is claimed is:

1. Device for driving a flexible lance for cleaning a heat exchanger duct or the like, provided with a frame in which a means driving a flexible lance is arranged for moving this flexible lance in the direction of an outlet opening, characterized in that the driving means is provided with a member which can be clamped around the flexible lance and which is movable in the frame towards and away from this outlet opening, said clamping member being formed by two parts which can be pressed against each other, each of which is mounted on an endless drive element, wherein the active parts of the two endless drive elements run parallel to each other.

2. Device as claimed in claim 1, characterized in that each endless drive element is provided with more than three clamping parts.

3. Device as claimed in claim 1, characterized in that the endless drive elements are arranged in the housing for movement away from and towards each other.

4. Device as claimed in claim 1, characterized in that the frame is also provided with at least one inlet opening for a flexible lance.

5. Device as claimed in claim 1, characterized in that the driving of the drive elements is performed hydraulically.

* * * * *